US008365418B2

(12) United States Patent
Tomasetti et al.

(10) Patent No.: US 8,365,418 B2
(45) Date of Patent: Feb. 5, 2013

(54) CABLE TIE REMOVAL TOOL

(76) Inventors: Kenneth Tomasetti, Phillipston, MA (US); David A. Hewes, Chesterfield, MA (US)

( * ) Notice: Subject to any disclaimer, the term of this patent is extended or adjusted under 35 U.S.C. 154(b) by 389 days.

(21) Appl. No.: 11/421,792

(22) Filed: Jun. 2, 2006

(65) Prior Publication Data

US 2007/0277383 A1 Dec. 6, 2007

(51) Int. Cl.
*B26B 17/00* (2006.01)

(52) U.S. Cl. ..... 30/286; 30/254

(58) Field of Classification Search ..... 30/128, 30/286, 258, 229, 175, 178, 179, 186, 120, 30/194, 254; 7/134, 158, 129–132; 81/3.6; D8/52, 57; 254/28; 140/123.6
See application file for complete search history.

(56) References Cited

U.S. PATENT DOCUMENTS

| | | | | | |
|---|---|---|---|---|---|
| 1,107,210 | A | | 8/1914 | Adams | |
| 1,621,576 | A | * | 3/1927 | Besancon | 29/248 |
| 1,878,500 | A | * | 9/1932 | Lingwood | 30/261 |
| 2,070,217 | A | * | 2/1937 | Seger | 254/22 |
| 3,772,780 | A | * | 11/1973 | Bahre | 30/90.2 |
| 4,229,881 | A | * | 10/1980 | Troxel | 30/254 |
| 4,844,417 | A | * | 7/1989 | Schneider-Muro | 254/28 |
| D337,247 | S | * | 7/1993 | Dart | D8/52 |
| 5,354,033 | A | * | 10/1994 | Cheldin | 254/28 |
| D368,417 | S | * | 4/1996 | Hebert | D8/52 |
| 5,797,922 | A | * | 8/1998 | Hessel et al. | 606/120 |
| 5,997,548 | A | * | 12/1999 | Jahanger | 606/120 |
| 6,772,996 | B1 | * | 8/2004 | Carlson et al. | 254/28 |
| D511,951 | S | * | 11/2005 | Sprouse | D8/52 |
| D596,910 | S | * | 7/2009 | Whitehead | D8/52 |
| 2006/0075642 | A1 | | 4/2006 | Elkins | |
| 2007/0240316 | A1 | * | 10/2007 | Yu et al. | 30/254 |

* cited by examiner

*Primary Examiner* — Laura M. Lee
(74) *Attorney, Agent, or Firm* — Brian M. Dingman; Mirick, O'Connell, DeMallie & Lougee, LLP

(57) ABSTRACT

A cable tie removal tool for cutting a cable tie off of an underlying structure with which the cable tie is engaged. The tool has an opposed pair of cutting members each having a cutting edge, the cutting members movable between an open position in which the cutting edges are spaced from one another and a cutting position in which the cutting edges are close together or touching. The tool also has a mechanical structure that holds at least one cutting member off of the underlying structure as the cutting members are moved from the open to the cutting position.

7 Claims, 9 Drawing Sheets

CABLE TIE REMOVAL TOOL

FIELD OF THE INVENTION

This invention relates to a tool for removing an installed cable tie.

BACKGROUND OF THE INVENTION

Cable ties generally consist of a band with a head attached to one end of the band. The free end of the band feeds through the head to form a loop enclosing the objects being tied together, which, for example, may be two or more electrical wires of a wiring harness. The head typically contains locking teeth which interlock with teeth in the band during band adjustment, and then maintain a desired band periphery. One example of a low-profile cable tie is found in U.S. Pat. No. 6,578,239, the disclosure of which is incorporated herein by reference.

Cable ties are normally finish-tightened and the extending tail is also cutoff by a tool that tightens the engaged tie to a pre-set tension and cuts off the tail in a single motion. If the tension is not properly set, the tie will be installed either too tightly or too loosely. If installed too tightly, the cable tie must be removed, and a replacement installed. There are many other situations in which installed cable ties need to be removed.

Most times, installed cable ties are removed with a pair of cutting pliers having opposed cutting jaws. In order to remove the cable tie, one jaw of the pliers must be forced underneath the cable tie. This can damage the underlying structures and compromise the wire bundle or other objects that are secured by the cable tie. For example, if the insulation jacket covering a wire is damaged, the wire will need to be replaced, which can be expensive, and is sometimes difficult or impossible to accomplish. Also, some strength and expertise is required in order to remove a cable tie in this manner, which means that the user must be properly trained in the use of the cutting tool.

SUMMARY OF THE INVENTION

It is therefore an object of this invention to provide a tool that removes an installed cable tie without damaging the structures that are secured by the cable tie, and without the need to force a cutting jaw underneath the tie.

The invention features a cable tie removal tool for cutting a cable tie off of an underlying structure with which the cable tie is engaged. The tool has an opposed pair of cutting members each having a cutting edge, the cutting members movable between an open position in which the cutting edges are spaced from one another and a cutting position in which the cutting edges are close together or touching. The tool also has a mechanical structure that holds at least one cutting member off of the underlying structure as the cutting members are moved from the open to the cutting position.

The cutting members may comprise jaws of cutting pliers. The jaws have distal tips, and the mechanical structure may comprise a first guard member that extends from the distal tip of a first cutting member toward the second cutting member, and a second guard member that extends from the distal tip of the second cutting member toward the first cutting member. The guard members may be misaligned sufficiently such that they do not meet head on when the jaws are closed to the cutting position, and are preferably misaligned sufficiently such that they lie side by side when the cutting members are in the cutting position. The guard members may each comprise a rounded portion proximate the cutting member from which it extends, and may each further comprise an extending distal tip portion projecting from the rounded portion. The tip portions may extend such that they are at approximately a right angle to the cutting edge of the cutting member.

The cutting edges may be about in the middle of the cutting members, or may be proximate the sides of the cutting members. The cable tie being removed may have a strap with a width, and the first guard member may extend from the first cutting member a distance that is about at least as far as the width of the cable tie. Alternatively, the first and second guard members may extend from the first and second cutting members, respectively, a distance such that they together span at least most of the width of the cable tie. The mechanical structure may alternatively comprise a guide that engages with the cutting members and guides them as they move.

BRIEF DESCRIPTION OF THE DRAWINGS

These and other objects and features of the invention will become more apparent based upon the following description together with the accompanying drawings, in which.

DETAILED DESCRIPTION OF THE PREFERRED EMBODIMENTS

Figure 1:
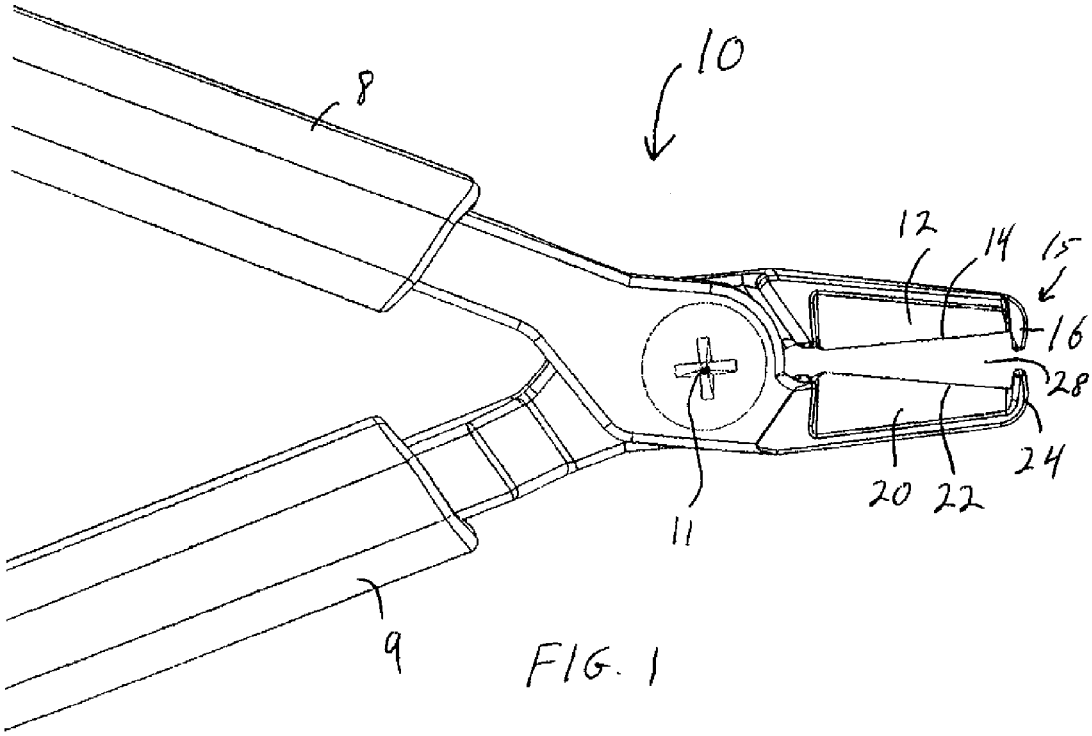
FIG. 1 is an enlarged view of the preferred embodiment of the invention.
Figure 2:
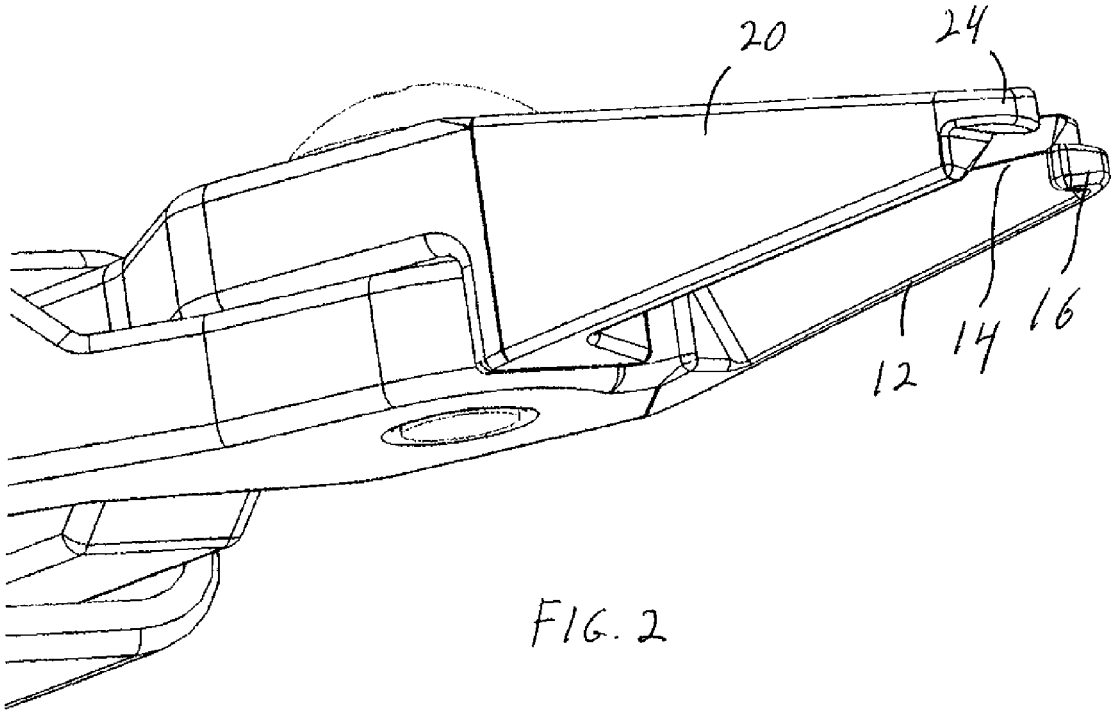
FIG. 2 is an enlarged perspective view of the working portions of the tool of FIG. 1.

The preferred embodiment of the tool of the invention is shown in FIGS. 1 through 4*b*. Tool 10 is used to cut a cable tie off of an underlying structure with which the cable tie is engaged. Tool 10 comprises an opposed pair of cutting members 12 and 20, each defining a cutting edge 14 and 22, respectively. Cutting members 12 and 20 are moveable between an open position in which the cutting edges are spaced from one another, shown in FIG. 1, and a cutting position in which the cutting edges are close together or touching. This movement is accomplished by movement of handles 8 and 9, as is known in the art. The cutting members that define cutting edges, and the operation of the tool, are similar to wire cutting tools such as diagonal cutting pliers. The cutting edges can be in the center of the jaws as shown in the drawings, or at or closer to the edges of the jaws.

Tool 10 further comprises a mechanical structure 15 that holds at least one cutting member 12, 20 off of the underlying structure as cutting members 12, 20 are moved from the open position to the cutting position. Typically, this mechanical structure comprises a projecting member located at the distal tip of one or both of the cutting members. In this preferred embodiment, guard members 16 and 24 are located at the distal tip of members 12 and 20, respectively. Members 16 and 24 each define a radiused or curved or rounded portion proximate the cutting member from which it extends, and an extending distal tip portion projecting from the rounded portion. The tip portion may extend at approximately a right angle to the cutting edge of the cutting member, as shown in the drawings.

Figure 3:
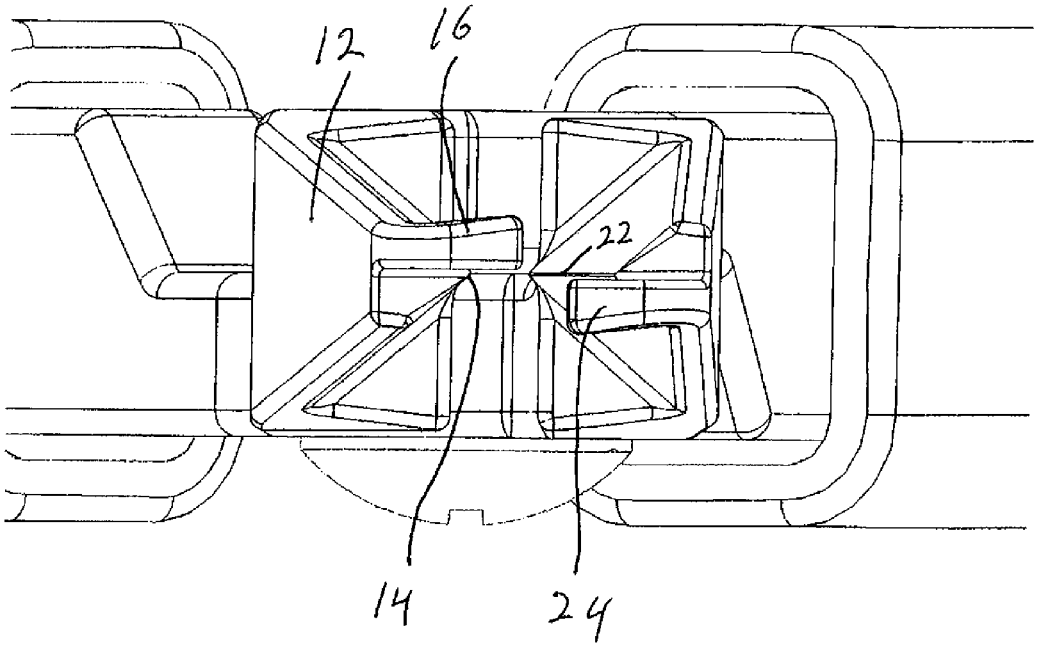
FIG. 3 is an enlarged close-up top view of the tool of FIGS. 1 and 2.
Figure 4A:
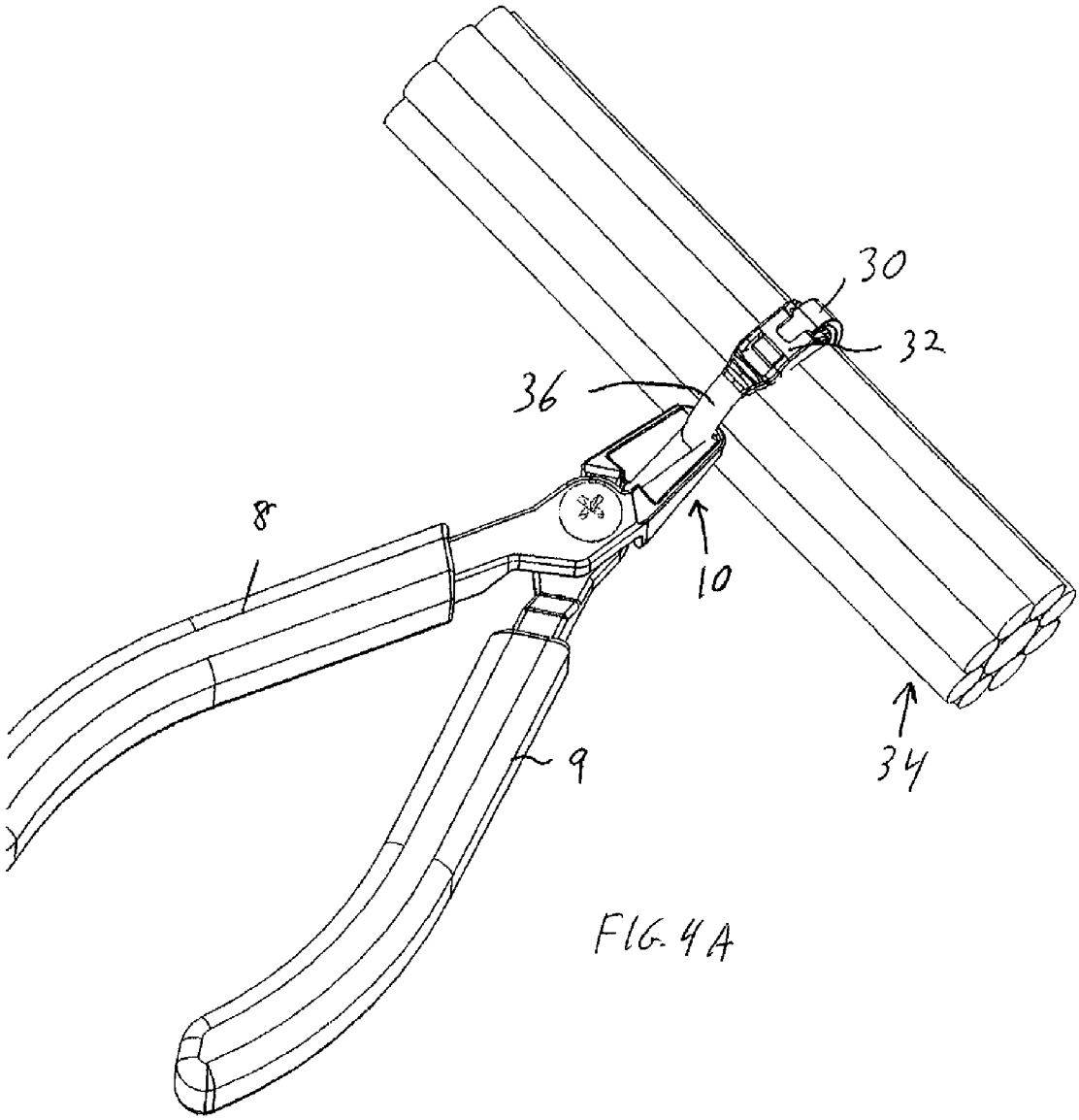
FIG. 4*a* shows the tool of FIGS. 1 through 3 in use cutting the strap of a cable tie.
Figure 4B:
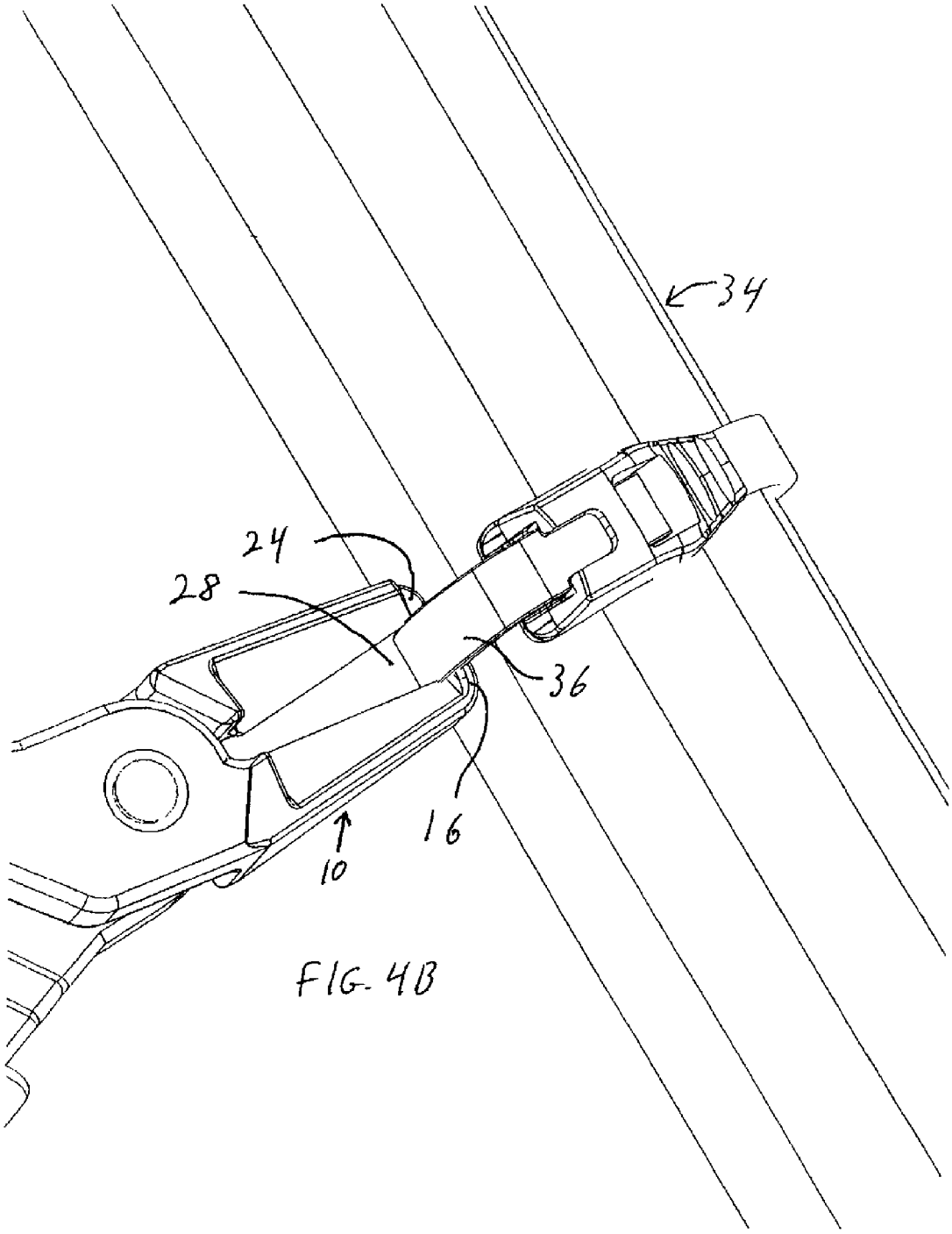
FIG. 4*b* is a close-up of the view of FIG. 4*a*.

Preferably, the guard members are essentially identical, but are off-set from one another relative to the cutting edges such that the cutting members can be moved together to bring the cutting edges together in order to properly cut the cable tie without the guard members meeting head-on when the jaws are closed to the cutting position. In this preferred embodiment, guard members 16 and 24 are off-set sufficiently from one another, as shown in FIG. 3, such that they lie side by side when the cutting edges are touching. That is, guard member 16 is on one side of cutting edge 14, which is co-planar with cutting edge 22. Guard member 24 is on the other side of the plane of the two cutting edges so that guard members 16 and 24 can be adjacent, but not touching so as not to interfere with the action of cutting edges 14 and 24.

In this preferred embodiment, cutting edges 14 and 22 are angled away from one another when the jaws are open as shown in FIG. 1. Because the jaws pivot about axis 11, the portions of the cutting edges closest to axis 11 are closer together than are the distal portions of the cutting edges. This construction creates a circular segment-shaped chamber 28 that closes down as the jaws come together. When the strap of a cable tie is located in chamber 28, this action forces the tie to the distal end of chamber 28 and lying against the inner portions of guard members 16 and 24. The guard members support the flat bottom section of the cable tie strap, and thus help to hold the strap in a position in which the two cutting edges contact the narrow edges of the cable tie strap and then cut it.

To use tool 10, the distal ends of cutting members 12 and 14 are placed proximate to the portion of the cable tie to be cut, and the pliers are squeezed to move cutting members 12 and 20 closer together. This causes guard members 16 and 24 to slip under strap 36 of cable tie 30, FIG. 4*a* and 4*b*. Cable tie 30 is engaged with cable bundle 34, and includes cable tie head 32. As jaws 8 and 9 are squeezed more, guard members 16 and 24 pull strap 32 slightly away from bundle 34 in a similar manner to the operation of a staple remover, so that cutting edges 14 and 22 eventually contact and then cut strap 36. Because the proximal portions of guard members 16 and 24 are radiused or rounded, the guard members do not puncture the sheathing over the cable of the cable bundle with which the tool engages. Guard members 16 and 24 also prevent cutting edges 14 or 22 from touching the cables, which prevents the cable tie removal action from penetrating the wire jacket. The result is that the tool can be used by virtually anyone to successfully remove a cable tie from a bundle of wires without compromising the integrity of any of the wires.

Figure 5:
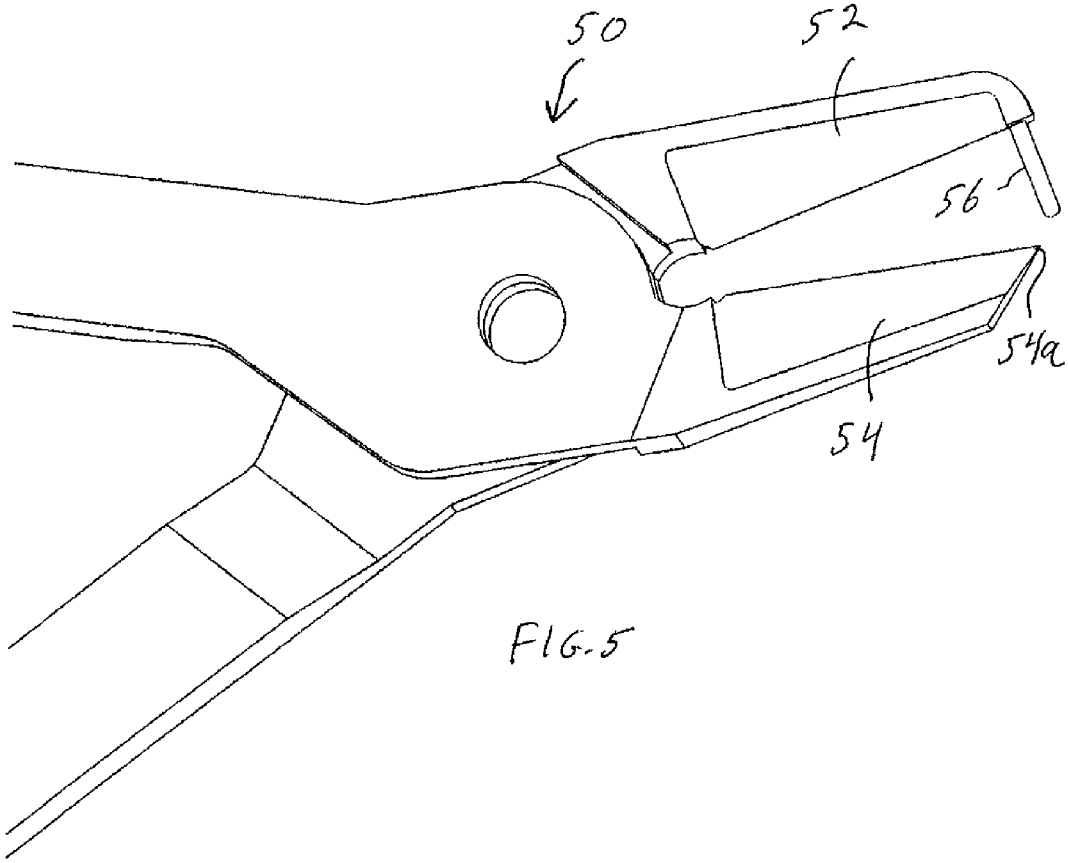
FIG. 5 shows an alternative embodiment.

Two alternative embodiments are shown in the additional drawings. FIG. 5 shows tool 50 with only a single guard member 56 protruding from the distal end of cutting member 52. Preferably, guard member 56 is at least as long as the width of any cable tie it will be used to cut, so that member 56 lies-between the full width of the cable tie and the underlying structure so as to prevent tip 54*a* of cutting member 54 from touching and thus potentially compromising the jacket of the wire on which the cable tie rests. This guard member length is not a necessary limitation of the invention, though, as virtually any length of projecting guard member will pull the cable tie sufficiently off of the underlying surface to allow it to be cut.

Figure 6:
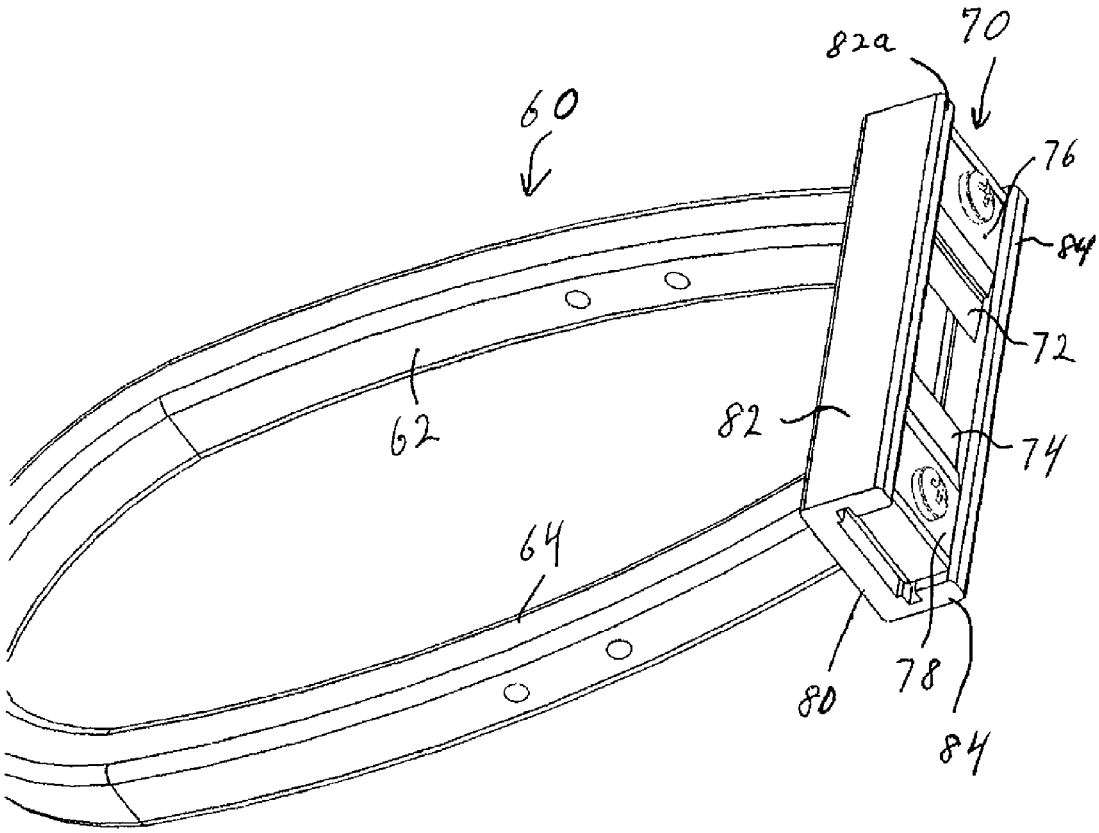
FIG. 6 shows yet another alternative embodiment.
Figure 7:
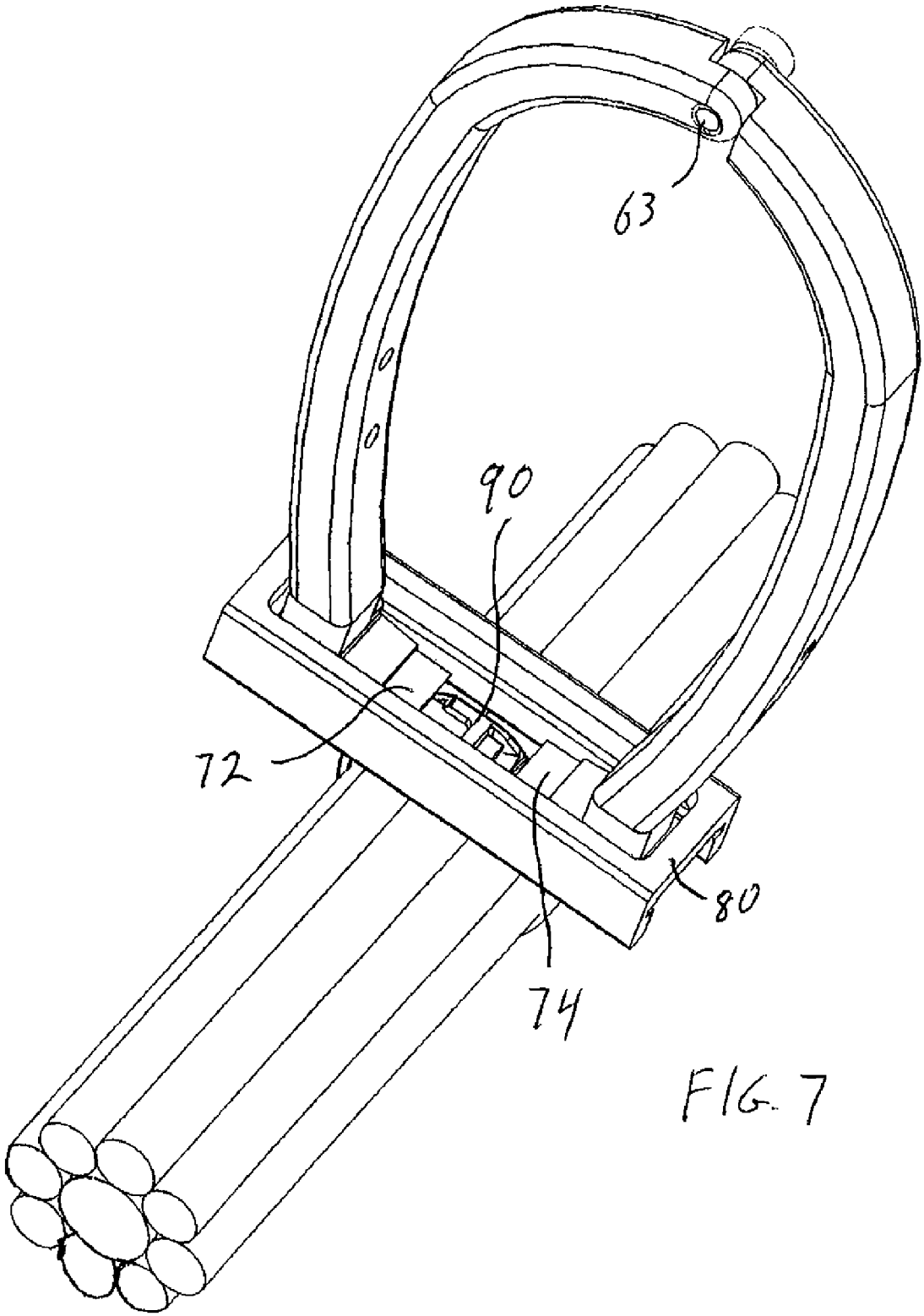
FIG. 7 shows the embodiment of FIG. 6 being used to cut off the head of an engaged cable tie.
Figure 8:
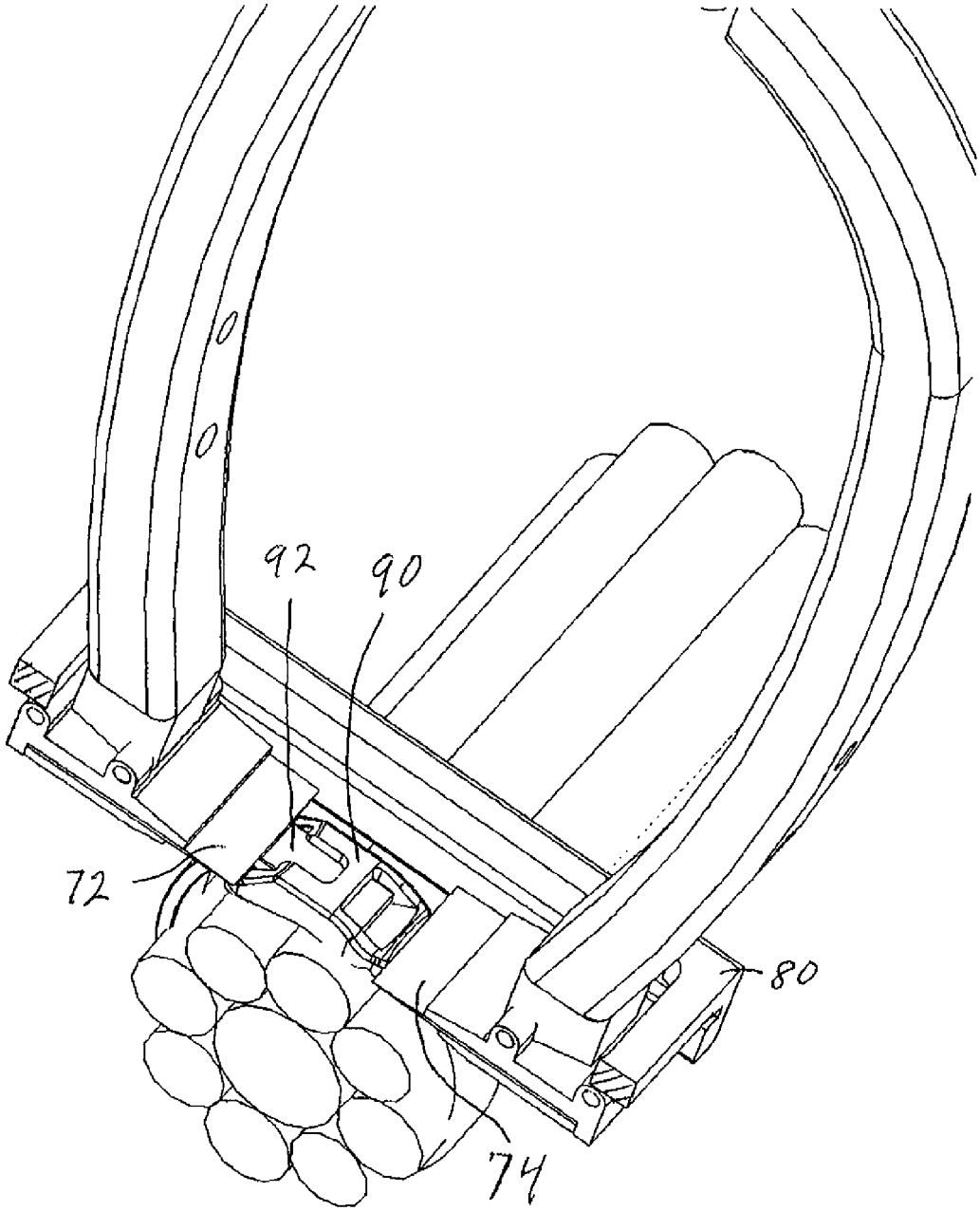
FIG. 8 is a view similar that of FIG. 7, but in partial cross-section to better depict the operation of this embodiment of the invention.

Tool 60, FIGS. 6 through 8, is designed to cut off a low profile head 90 of cable tie 92, as best shown in the partial broken away view of FIG. 8. Tool 60 includes moveable handles 62 and 64 that move cutting edges 72 and 74 towards and away from one another. These cutting edges are carried by cutting members 76 and 78, respectively. These cutting members move within mechanical structure 80 that guides the cutting members and also defines legs 82 and 84 with protruding surfaces 82*a* and 84*a* that project farther than cutting edges 72 and 74 to prevent the cutting edges from contacting the cable tie.

Tool 60 is used by placing the tool over a cable tie such that the cutting edges are on each side of cable tie head 90, as shown in FIGS. 7 and 8. Handles 62 and 64, which pivot about point 63, are then squeezed together to move cutting edges 72 and 74 closer together until the cutting edges slice off the top of cable tie head 90. This releases strap 92 from head 90, and thus allows the cable tie to be removed from the wire bundle.

Although specific aspects of the invention are shown in some drawings and not others, this is not a limitation of the invention. Rather, the invention is defined by the following claims.

What is claimed is:

1. A cable tie removal tool for cutting a cable tie from an underlying structure with which the cable tie is engaged, comprising:

an opposed pair of jaws, each jaw of the pair of jaws having a cutting member defining a cutting edge extending between a proximal end of the jaw in proximity to an axis of rotation of the opposed pair of jaws and a distal tip of the jaw, the opposed pair of jaws movable between an open position in which the cutting edges are spaced from one another to define a segment-shaped opening there between, and a cutting position in which the cutting edges are disposed in proximity to each other;

the first cutting member of the first jaw of the pair of jaws defining a first angle relative to an opposing base portion of the first jaw such that the first cutting member and the first cutting edge tapers down from the proximal end of the first jaw toward the distal tip of the first jaw along a longitudinal axis of the first jaw;

the second cutting member of the second jaw of the pair of jaws defining a second angle relative to an opposing base portion of the second jaw such that the second cutting member and the second cutting edge tapers down from the proximal end of the second jaw toward the distal tip of the second jaw along a longitudinal axis of the second jaw;

a mechanical structure configured to position at least one cutting member off of the underlying structure as the cutting members are moved from the open position to the cutting position, where the mechanical structure comprises:

a first guard member that extends from the distal tip of the first jaw toward the second jaw, a longitudinal axis of the first guard member being substantially perpendicular to the longitudinal axis of the first jaw and extending at approximately a right angle to the cutting edge from which it extends, such that the tip portions of the guard members extend into the segment-shaped opening, the first guard member comprising a first cable tie contact portion and a first guard member base portion opposing the first cable tie contact portion, the first cable tie contact portion defining an obtuse angle relative to the first cutting member of the first jaw, the first cable tie contact portion and the first guard member base portion defining a substantially wedge-shaped structure, and a second guard member that extends from the distal tip of the second jaw toward the first jaw, a longitudinal axis of the second guard member being substantially perpendicular to the longitudinal axis of the second jaw and extending at approximately a right angle to the cutting edge from which it extends, such that the tip portions of the guard members extend into the segment-shaped opening, the second guard member comprising a second cable tie contact portion and a second guard member base portion opposing the second cable tie contact portion, the second cable tie contact portion defining an obtuse angle relative to the second cutting member of the second jaw, the second cable tie contact portion and the second guard member base portion defining a substantially wedge-shaped structure, the first guard member and the second guard member configured to engage the cable tie and pull the cable tie from the distal tips of the opposed pair of jaws and toward the proximal ends of the opposed jaws as the opposed pair of jaws move between the open position and the cutting position; and where the guard members are misaligned sufficiently such that they do not meet head on when the cutting members are closed to the cutting position and the guard members are disposed in an overlapping arrangement when the cutting members are disposed in the cutting position.

2. The cable tie removal tool of claim 1, in which the first guard member base portion comprises a rounded portion proximate the base portion of the first jaw and the second guard member base portion comprises a rounded portion proximate the base portion of the second jaw.

3. The cable tie removal tool of claim 1 in which the cable tie being removed has a strap with a width, and the first guard member extends from the first cutting member a distance that is about at least as far as the width of the cable tie.

4. The cable tie removal tool of claim 1 in which the cable tie being removed has a strap with a width, and the first and second guard members extend from the first and second cutting members, respectively, a distance such that they together span at least most of the width of the cable tie.

5. The cable tie removal tool of claim 1, where the opposed pair of cutting members pivot about the axis of rotation, the opening between the cutting edges is a circular sector having a center located approximately at the axis, and the extending distal tip portions of the guard members form at least a portion of an arc of the opening between the cutting edges.

6. The cable tie removal tool of claim 1, wherein the first cable tie contact portion defines a substantially flat surface and the second cable tie contact portion defines a substantially flat surface.

7. The cable tie removal tool of claim 1, wherein:

the first angle is configured as an acute angle relative to the opposing base portion of the first jaw; and the second angle is configured as an acute angle relative to the opposing base portion of the second jaw.

* * * * *